US010438519B1

(12) United States Patent
Bacallao

(10) Patent No.: US 10,438,519 B1
(45) Date of Patent: Oct. 8, 2019

(54) WIND-RESISTANT SIGN ASSEMBLY

(71) Applicant: Walter Bacallao, Parkland, FL (US)

(72) Inventor: Walter Bacallao, Parkland, FL (US)

( * ) Notice: Subject to any disclaimer, the term of this patent is extended or adjusted under 35 U.S.C. 154(b) by 0 days.

(21) Appl. No.: 16/178,009

(22) Filed: Nov. 1, 2018

(51) Int. Cl.
*G09F 7/22* (2006.01)
*G09F 7/18* (2006.01)

(52) U.S. Cl.
CPC ..... *G09F 7/22* (2013.01); *G09F 2007/1804* (2013.01); *G09F 2007/1834* (2013.01)

(58) Field of Classification Search
CPC ..... G09F 7/22; G09F 2007/1804; G09F 2007/1834
See application file for complete search history.

(56) References Cited

U.S. PATENT DOCUMENTS 123,871 A * 2/1872 Crane et al. ..... G09F 7/22 40/617
574,584 A * 1/1897 Staten ..... G09F 7/22 40/617
867,554 A * 10/1907 Brundell ..... G09F 7/22 40/613
1,449,063 A * 3/1923 Shotwell ..... G09F 7/22 40/613
1,750,118 A 3/1930 Mueller, Jr. et al.
1,823,404 A * 9/1931 Marx ..... G09F 7/22 40/613
2,084,818 A 6/1937 Neil
2,746,187 A 5/1956 Ennever
3,521,390 A 7/1970 Carlson
4,071,970 A 2/1978 Strizki
4,503,631 A 3/1985 Kelly
4,910,898 A * 3/1990 Hector ..... G09F 7/22 40/479
5,394,631 A 3/1995 Bosio
5,964,052 A 10/1999 Jepsen et al.
6,658,772 B2 12/2003 Haghighi
7,562,477 B2 7/2009 Kurple et al.
8,028,448 B2 10/2011 Amrani
8,800,187 B2 8/2014 Peterson
2005/0097796 A1* 5/2005 Kaminski ..... G09F 7/22 40/606.15
2006/0254102 A1* 11/2006 Mayants ..... G09F 7/18 40/602
2007/0056694 A1 3/2007 Mullet
2008/0141596 A1 6/2008 Kelly et al.
(Continued)

*Primary Examiner* — Gary C Hoge
(74) *Attorney, Agent, or Firm* — Mark C. Johnson; Johnson | Dalal

(57) ABSTRACT

A wind-resistant sign assembly that includes vertical support members coupled to multiple horizontally oriented sign panels that substantially span a length separating the support members. The sign panels are disposed in a static position, wherein they are disposed at a substantially planar configuration with one another and are operably configured to individually rotate to a dynamic position when exposed to a force generated by incoming wind. The dynamic position includes the front surface of one of the plurality of sign panels disposed at an acute angle with respect to the front surface of at least one other adjacent sign panel, thereby defining a gap between said sign panels to permit the entry and egress of the wind through the sign, and return, through use of one or more hinge and spring members, to the static position.

15 Claims, 11 Drawing Sheets

(56) References Cited

U.S. PATENT DOCUMENTS

| | | | | |
|---|---|---|---|---|
| 2010/0122481 | A1 | 5/2010 | Xu | |
| 2011/0197480 | A1 | 8/2011 | Nasiatka | |
| 2012/0280194 | A1* | 11/2012 | Stanojevic | A47C 1/121 256/26 |
| 2013/0055603 | A1* | 3/2013 | Ayad | G09F 11/02 40/597 |

* cited by examiner

WIND-RESISTANT SIGN ASSEMBLY

FIELD OF THE INVENTION

The present invention relates generally to display or sign devices, assemblies, apparatuses, other outdoor advertising structures, and the like. More particularly, the present invention relates to multiple-panel outdoor signs which are designed to be windproof.

BACKGROUND OF THE INVENTION

Typically, an advertising sign is a public display which contains information meant to be disseminated widely to the public and intended to lead to awareness of and/or economic benefit to an entity. Often, advertising signs are placed outdoors in high traffic areas to reach the broadest possible audience. For instance, many advertising signs are placed on the side of roads, highways, and public tracks. However, this practice has several drawbacks. As a result of being placed outdoors, these signs are constantly exposed to all kinds of weather conditions such as rain, wind, snow, storms, and the like. These weather forces, namely wind, may cause the sign to fall over, which may lead to damaging the sign or even breakage. For these reasons, maintaining an advertising sign over a period of time may become costly and commercially impracticable for a user. As such, development of signs employing methods which focus on wind-resistance have emerged. These efforts, however, have resulted in the creation of signs that are often inefficient or have not been able to address consumer needs.

Several known paneled advertising signs are aimed at enabling a paneled portion of the sign to break away without detaching when impacted by a force, such as a vehicle. As such, these devices are typically used as roadside signs and fail to provide for effective wind-resistance while maintaining the integrity of the display of the sign. Moreover, the sign's panel does not contain coupled hinges which allow for the immediate return to the panel's original position. Said another way, for the sign's panel to return to its original position, it must be done by way of user interaction or user intervention.

Other known windproof advertising signs that do employ hinges, still require user interaction through use of a rod and/or a crank assembly that are operable to be manually operated by a user. To that end, when wind forces are exerted upon the device, it is intentionally designed to fall and maintain its original structure using a series of support and linkage mechanisms. However, for the advertising sign to be placed back to its upright position, a user must physically crank the sign back into its upright position. As such, these devices are burdensome, time-intensive, and inefficient at eliminating the human actor while maintaining the windproof characteristic.

Many other known paneled display devices can collapse and become compact, thereby allowing for easy storage. However, these devices are designed to accomplish the objective of facility of stowage and not wind-resistance.

Other known multiple-panel advertising signs enable a series of messages to be changed via a control and are aimed at presenting multiple advertisements using a single billboard. Although useful for displaying multiple messages within a single device, this system does not provide an effective means of wind resistance.

Some other known wind resistant multiple-paneled advertising signs enable wind flow through the advertising sign but align the panels vertically instead of horizontally, such as U.S. Pat. No. 1,823,404 (Marx et al.). These devices also utilize a series of weights and flexible connections to place the sign back to its unitary position. However, there are several drawbacks to these devices; for example, these devices incorporate a combination of different connective materials, thereby making them more expensive, and are complex and complicated to assemble.

Other known paneled advertising signs are aimed at being able to withstand blows of wind by pivoting on acute angle rotations on an axis supported by a frame. Further, these advertising signs feature the panel being coupled to either a weight or tension springs which maintain the panel in an upright position. However, these devices consist of a single panel as opposed to multiple, and do not allow the wind to successfully flow through the panel. Moreover, these signs stand atop a portable stand, making them more temporary, such as for sidewalk use.

Some other known wind resistant advertising signs are aimed at being portable and consist of a single panel coupled to a base which has fixed legs. However, these devices also suffer from several disadvantages. Specifically, since these signs consist of a single panel and a base which is not fixed to the ground, the sign is still vulnerable to wind as it could fall over when severe wind forces are exerted upon it. Moreover, the single panel does not allow for wind to flow through the sign's panels and return to their original position once the force terminates.

Therefore, a need exists to overcome the problems with the prior art as discussed above.

SUMMARY OF THE INVENTION

The invention provides a wind-resistant sign assembly that overcomes the hereinafore-mentioned disadvantages of the heretofore-known devices and methods of this general type and that effectively allows for the entry and egress of wind flow through the multiple-panel design without destroying, damaging, or allowing the sign to fall over.

With the foregoing and other objects in view, there is provided, in accordance with the invention, a wind-resistant sign assembly comprising at least a first and second sign support member disposed in a substantially parallel orientation (+/−15°) with respect to one another and defining a space thereinbetween. The wind-resistant sign assembly also includes a plurality of sign panels operably configured to independently rotate with respect to one another.

In some embodiments, the first and second sign support members inserted into, and disposed in a substantially orthogonal orientation with respect to, a ground surface to define a space separating the first and second sign support members. The wind-resistant sign assembly also includes a plurality of sign panels.

In some embodiments, each of the plurality of sign panels having a first side end, a second side end opposing the first side end, an upper end, a bottom end opposing the upper end, a rear surface, a front surface opposing a back surface, and a sign length separating the first and second side ends of the sign panel and spanning the space separating the first and second sign support members. Moreover, the sign panels are coupled to the sign support members via a plurality of hinge members. The plurality of hinge members each having a spring member and coupling the sign panel to the first and second sign support members, respectively. Additionally, each of the plurality of sign panels operably configured to independently rotate with respect to one another along a sign panel rotation path having a static position and a dynamic position, the static position with the front surfaces of each of the plurality of sign panels biased, through a spring force generated by the spring member, in a configuration with one another to define a substantially planar collective front sign surface defining a static sign plane and the dynamic position with at least one of the plurality of sign panels rotated and disposed at an acute angle with respect to the static sign plane for entry and egress of wind.

In accordance with another feature, the dynamic position further comprises the front surface of the at least one of the plurality of sign panels disposed at an acute angle with respect to the front surface of another of the plurality of sign panels disposed adjacently thereto to define a gap between the bottom end along the sign panel length and the upper end of the another of the plurality of sign panels disposed adjacently thereto.

In accordance with another feature, the front surfaces of each of the plurality of sign panels span the sign length.

In accordance with another feature, the plurality of sign panels are operably configured to independently and bi-directionally rotate with respect to the static sign plane.

In accordance with another feature, a plurality of panel off-set post members, each with a first end directly coupled to at least one of the first and second sign support members, a second end, opposite the first end of the respective panel off-set post member, coupled to one of the plurality of hinge members, and displacing each of plurality of sign panels a distance away from the at least one of the first and second sign support members to which it is coupled.

In accordance with another feature, each of the plurality of panel off-set post members further comprise a post length separating the first and second ends of the panel off-set post member, the post length greater than or equal to a sign-panel width separating the upper and bottom ends of each of the plurality of sign panels spanning the sign length.

In accordance with another feature, the sign-panel width is of a substantially uniform length.

In some embodiments, each of the plurality of sign panels comprises a first side end, a second side end opposing the first side end, an upper end, a bottom end opposing the upper end, a rear surface, a front surface opposing a back surface, and a sign length separating the first and second side ends. Moreover, the sign panels are coupled to the sign support members via a plurality of hinge members. When the sign panels lay in a static position along a sign panel rotation path, the front surface of each panel is coplanar with, and the bottom end along the sign length disposed proximal to, the front surface and upper end, respectively, of one of the plurality of sign panels disposed adjacently thereto. When the sign panels are in dynamic position along the sign panel rotation path, the front surface of one of the plurality of sign panels is disposed at an acute angle with respect to the front surface of one of the plurality of sign panels disposed adjacently thereto to define a gap between the bottom end along the sign panel length and the upper end of the one of the plurality of sign panels disposed adjacently thereto for entry and egress of wind.

In accordance with another feature, an embodiment of the present invention, the wind-resistant sign assembly further comprises a first and second sign support member which are independently and indirectly coupled with one another.

In accordance with another feature of the present invention, each of the plurality of hinge members further comprises a spring member generating a spring force biasing each of the respectively coupled plurality of sign panels in the static position.

In accordance with another feature, the static position defines a substantially planar collective front sign surface defined by the front surfaces of each of the plurality of sign panels.

In accordance with another feature, the front surfaces of each of the plurality of sign panels span the sign length.

In accordance with another feature, the substantially planar collective front sign surface further comprises a static sign plane, wherein the plurality of sign panels are operably configured to independently and bi-directionally rotate with respect to the static sign plane.

In accordance with another feature, the wind-resistant sign further comprises a plurality of panel off-set post members, each with a first end directly coupled to at least one of the first and second sign support members, a second end, opposite the first end of the respective panel off-set post member, coupled to one of the plurality of hinge members, and displacing each of plurality of sign panels a distance away from the at least one of the first and second sign support members to which it is coupled.

In accordance with another feature, each of the plurality of panel off-set post members further comprise a post length separating the first and second ends of the panel off-set post member, the post length greater than or equal to a sign-panel width separating the upper and bottom ends of each of the plurality of sign panels spanning the sign length.

In accordance with another feature, the sign-panel width is of a substantially uniform length.

One objective of the present invention is to provide a stable, durable, weather-proof and wind-resistant sign assembly.

Another objective is to display and communicate advertisements, messages, or notices composed of text and/or images to the public through viewing the sign panels collectively in their static position.

Another objective is to enable each of the plurality of sign panels to be able to independently rotate, facilitated by the coupled hinges, along the sign panel rotation path to a dynamic position when presented with an exerting force.

Another objective is to enable the plurality of sign panels to be able to retain their static position, facilitated by the coupled hinges and/or coupled weights, until presented with a strong and unsustainable exerting force.

Another objective is to enable each of the plurality of sign panels to be able to independently and immediately return to their original static position when the exerting force terminates, by way of the coupled hinges and/or coupled weights, without the need for human intervention.

Yet another objective is to enable each of the plurality of sign panels to be able to independently and bi-directionally rotate along the sign panel rotation path, allowing for the entry and egress of wind from both directions.

Although the invention is illustrated and described herein as embodied in a wind-resistant sign assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the panels of the sign.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

FIG. 2 is a fragmentary perspective close-up rear view of the wind-resistant sign assembly in

FIG. 1;

DETAILED DESCRIPTION

Figure 1:
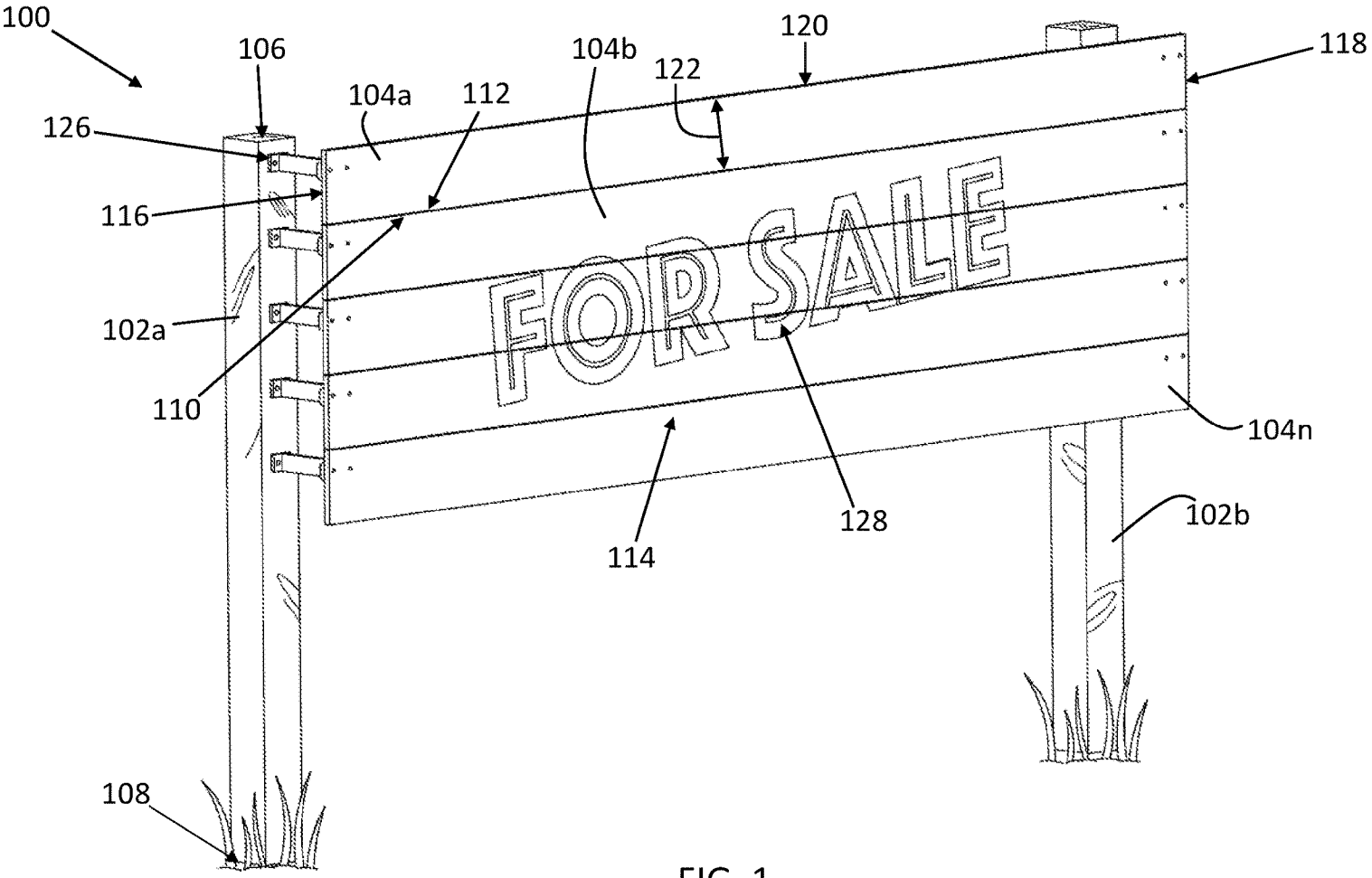
FIG. 1 is a perspective view of a wind-resistant sign assembly according to one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms. Therefore, specific structural and functional details disclosed herein are not to be interpreted as limiting, but merely as a basis for future claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not drawn to scale.

The present invention provides a novel and efficient wind-resistant sign assembly that may be utilized, for example, as a road sign for highways, street sign, or other advertising or display application. More specifically, embodiments of the invention provide a sign composed of a plurality of sign panels that are each coupled to posts through hinges on either side of a panel and allow for the rotation of said panels, thereby effectively allowing for the entry and egress of wind flow without destroying, damaging, or allowing the sign to fall over. In addition, embodiments of the present invention provide sign panels which are coupled to a variety of mechanisms that allow for the sign panels to return to their original or static position without the need for human intervention in an efficient and cost-effective manner.

Figure 2A:
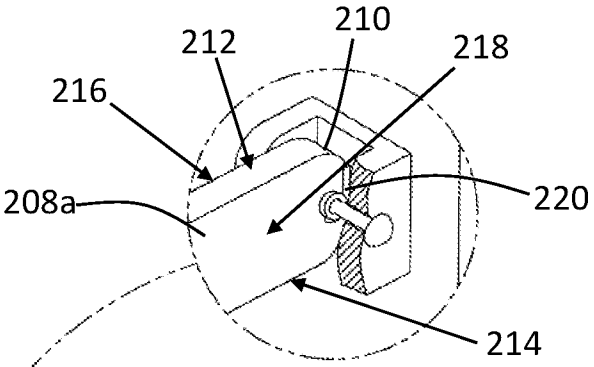
FIG. 2A is a close-up view of a spring-loaded hinge of the wind-resistant sign assembly in FIG. 2A in accordance with one embodiment of the present invention.
Figure 2:
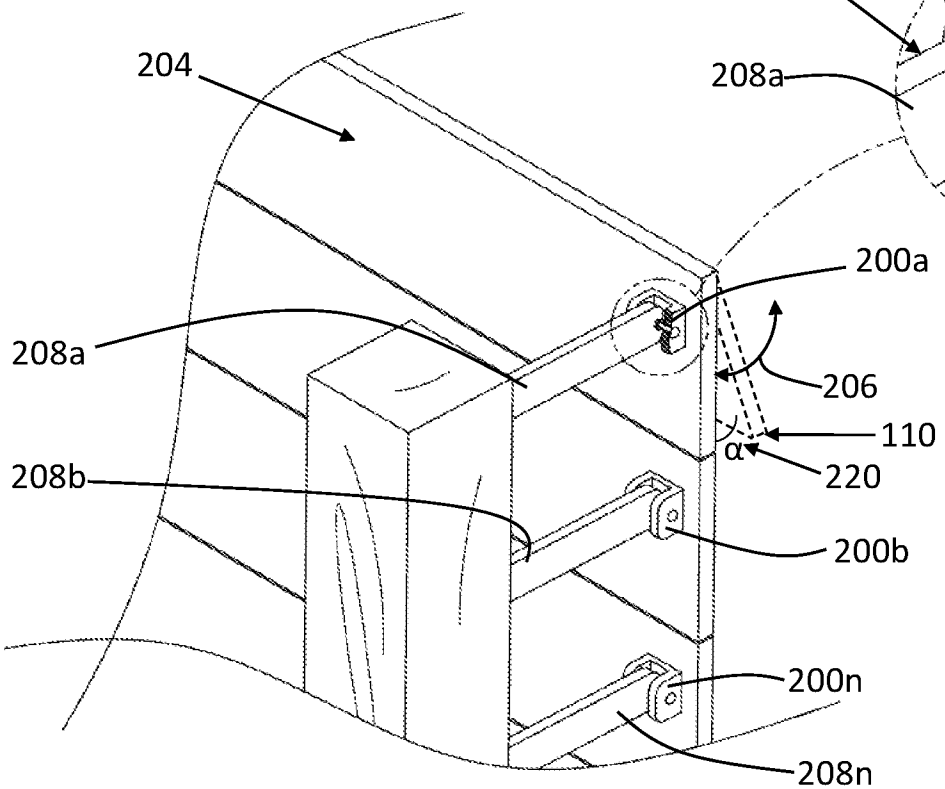
Figure 3:
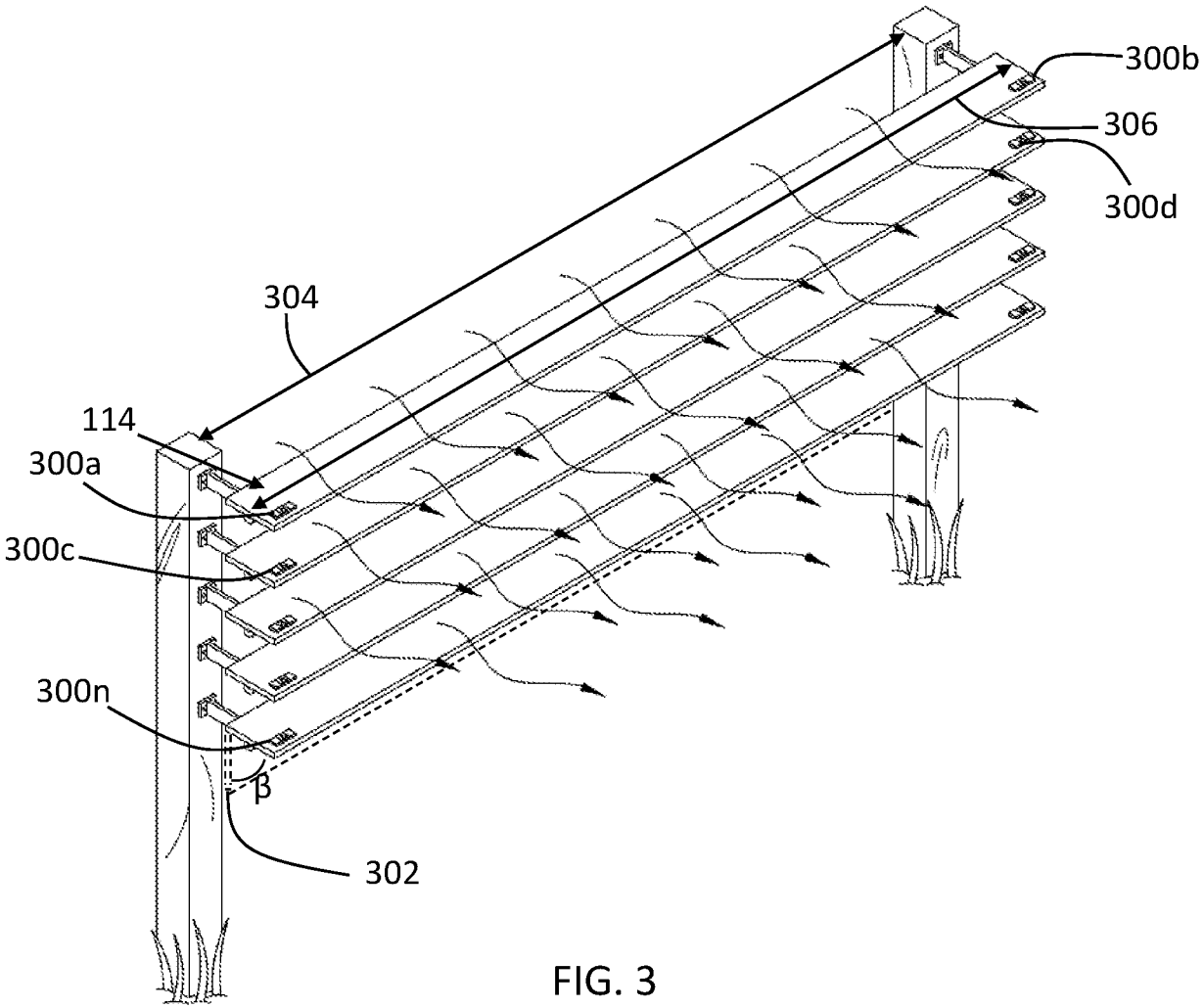
FIG. 3 is a perspective view of the wind-resistant sign assembly in FIG. 1 with a plurality of sign panels angled to permit entry and egress of wind in according with one embodiment of the present invention.

Referring now to FIG. 1-3, one embodiment of the present invention is shown in a perspective view. FIG. 1, along with other figures, show several advantageous features of the present invention, but, as will be described below, the invention can be provided in several shapes, sizes, combinations of features and components, and varying numbers and functions of the components. The first example of a wind-resistant sign assembly 100, as shown best in FIGS. 1-2, includes sign support members 102*a-n*, where "n" represents any number greater than 1. The wind-resistant sign assembly 100 usefully includes two sign support members 102*a-b*. The assembly 100 also beneficially includes a plurality of sign panels 104*a-n* that are operably configured to independently rotate or pivot at an acute angle with respect to one another to permit the entry and egress of wind. The assembly 100 may also beneficially include a plurality of panel off-set post members 208*a-n* coupling one or more sign panels 104*a-n* to the sign support members 102*a-n*, or posts. To effectuate rotation of the plurality of sign panels 104*a-n*, the assembly 100 may utilize a plurality of hinge members 200*a-n* having various configurations, placement positions, and operability. The hinge members 200*a-n* facilitate in coupling the sign panels 104*a-n* to the support members 102*a-n* and/or off-set post members 208*a-n*.

In one embodiment, the first sign support member 102*a* and the second sign support member 102*b* may beneficially stand in a substantially parallel orientation (+/−15°) with respect to one another to effectuate placement and stability of the wind-resistant sign assembly 100, while effectively displaying the indicia 128 or content disposed on a front surface 114 of the sign panel(s) 104*a-n*. One or both of the sign support members 102*a-b* may include a substantially planar upper end 106, a substantially planar bottom end 108 opposing the upper end 106. The length between the upper and bottom ends 106, 108 define a height of the sign support member. The sign support members 102*a-b* may also include substantially planar sides or surfaces. In one embodiment, the sign support members 102*a-b* may be of a wood material that may be coated with a waterproof coating to sustain outside environmental conditions. In other embodiments, the sign support members 102*a-b* may be of a rigid metallic material (e.g., stainless steel), a polymeric material (e.g., PVC), or other substantially rigid material that is operable to be inserted into a ground surface, e.g., dirt. In another embodiment, the sign support members 102*a-b* may be rods, tubes, poles or shafts.

In one embodiment, the first and second sign support members 102*a-b* may be placed at separate, distant places in the ground, being apart from one another and having a space disposed in-between the support members 102*a-b*. As shown best in FIG. 3, the width 304 separating the sign support members 102*a-b*, e.g., 1-4 feet, may also substantially equal the longitudinal width 306 of the sign panels 104*a-n*. The bottom end of the sign support members 102*a-b* may be buried in the ground to a certain depth, depending on the height of the sign support members 102*a-b*. In another embodiment, the first and second sign support members 102*a-b* may be placed on a stand which may be made of various materials including, but not limited to, wood, metal, cement, or plastic. In another embodiment, the first and second sign support members 102*a-b* may be independently and indirectly coupled with one another.

In another embodiment, the wind-resistant sign assembly 100 includes the first and second sign support members 102*a-b*, which may beneficially be disposed in a substantially orthogonal orientation with respect to a ground surface to effectuate placement and stability of the wind-resistant sign assembly 100. The first and second sign support members 102*a-b* a define a space separating the first and second sign support members.

To effectively permit the entry and egress of wind, the wind-resistant sign assembly 100 incorporates a plurality of sign panels 104*a-n* operably configured to independently rotate with respect to one another. The sign panels 104*a-n* may rotate at acute angle rotations with respect to an adjacently disposed panel, as exhibited by angle $\alpha$ in FIG. 2, when presented by an external force such as wind. Taking sign panel 104*a* as an example, said sign panel 104*a* may include a substantially planar first side end 116 and a substantially planar second side end 118, opposing the first side end 116. The length 306 (shown in FIG. 3) between the first and second side ends 116, 118 defines the sign width. The sign panel 104*a* may also includes a substantially planar upper end 120, a substantially planar bottom end 112 opposing the upper end 120, a substantially planar rear surface 204, and a substantially planar front surface 114 opposing the rear surface 204. Further, the front surfaces of each of the plurality of sign panels 104*a-n* may span the sign length 306 (shown in FIG. 3). In one embodiment, the sign panels 104*a-n* are of a wood material that may be coated with waterproof coating to sustain outside environmental conditions. In other embodiments, the sign panels 104*a-n* are of a rigid metallic material (e.g., stainless steel), a polymeric material (e.g., PVC), or other substantially rigid material.

It should be understood that terms such as "front," "rear," "side," top," "bottom," and the like are indicated from the reference point of a viewer viewing the wind-resistant sign assembly 100 from its front surface 114 when the panels 104*a-n* of the wind-resistant sign assembly 100 are displaying an advertisement or message 128. In some embodiments, each sign panel 104*a-n* will be of a substantially uniform length. Said another way, the width of each sign panel 104*a-n* will be the same or within +/−5-10% deviation from one another.

With specific reference to FIG. 2, the sign panels 104*a-n* of the wind-resistant sign assembly 100 are each individually beneficially capable of rotation along the sign panel rotation path (represented in an exemplary path with lines 206). In one embodiment, the sign panel rotation path 206 is circular. However, the sign panel rotation path 206 may also be of another shape or follow another path. As such, the sign panels 104*a-n* may rest in a static position, wherein the sign panels 104*a-n* are configured to display a substantially planar collective front sign surface 114 defined by the front surfaces of each of the plurality of sign panels 104*a-n*. Additionally, when an external force is exerted on the front and/or rear surfaces 114, 204 of the sign panels 104*a-n*, such as wind, the sign panels 104*a-n* are operably configured to rotate along the sign panel rotation path 206 to a dynamic position 202 (shown best in FIG. 2).

In one embodiment, the placement of the individual sign panels 104*a-n*, when lying in static position, are in close proximity to one another. For example, sign panels 104*a-b* may be juxtaposed, wherein the front surface 114 of sign panel 104*a* is coplanar with the front surface 114 of sign panel 104*b*. Moreover, the bottom end 112 of sign panel 104*a* may be proximal to, i.e., at or substantially near within approximately 1 inch of, the upper end 110 of sign panel 104*b*. Additionally, when the sign panels 104*a-n* are displayed in their original or static positions, they sit flush with one another, or, said another way, are disposed in a parallel orientation with respect to the orientation of the support members 102*a-n*. Moreover, the sign panels 104*a-n*, when viewed collectively as a whole, may display an image, text, or a combination of images and text, e.g., "For Sale" 128, to convey an advertisement or message to viewers, as best seen in FIG. 1. The panels may display a message from one or both surface sides 114, 204.

With reference to FIGS. 1-3, when an external force is subjected to one of the plurality of sign panels 104*a-n*, it will be placed in a dynamic position, wherein the front surface 114 of said sign panel may be disposed at an acute angle, α, with respect to an orientation of a front surface of one of the plurality of sign panels 104*a-n* disposed adjacently thereto to define a gap, e.g., gap 220, between the bottom end 112 along the sign panel length 306 and the upper end 110 of the one of the plurality of sign panels 104*a-n* disposed adjacently thereto for entry and egress of wind (as best seen in FIG. 3). As best seen in FIGS. 2-3, the gap 220 between the bottom end 112 along the sign panel length 306 and the upper end 110 of the one of the plurality of sign panels 104*a-n* disposed adjacently thereto may be of a uniform, or substantially the same, length spanning the sign panel length 306. The figures also depict the bottom end 112 of each of the sign panels 104*a-n* being "free," or unconnected to any ancillary structure to enable independent rotation of each panel.

Figure 4:
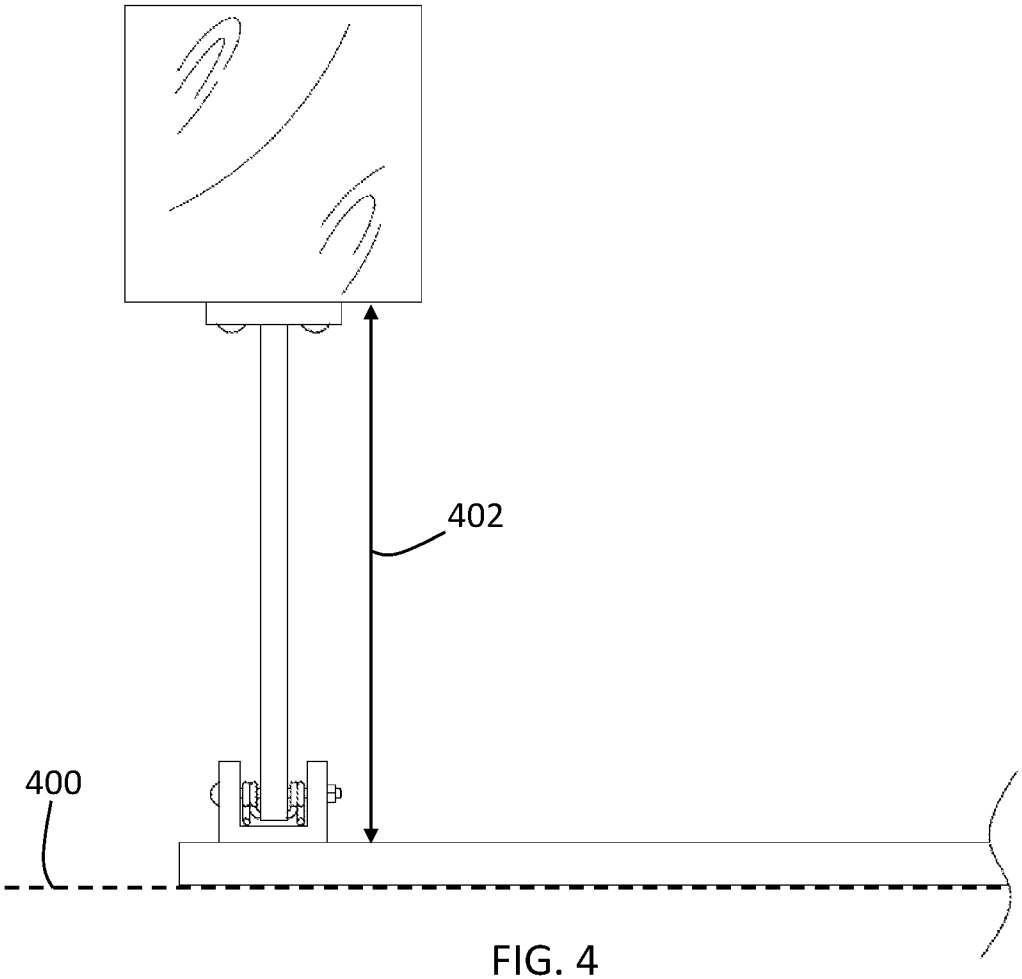
FIG. 4 is a fragmentary top plan view of the wind-resistant sign assembly in FIG. 1 in accordance with one embodiment of the present invention.

With reference now to FIGS. 1-2 and 4, the substantially planar collective front sign surface 114 of the wind-resistant sign assembly 100 may define a static sign plane 400 (shown best in FIG. 4). The plurality of sign panels 104*a-n* may be operably configured to independently and bi-directionally rotate with respect to the static sign plane 400. Said another way, the plurality of sign panels 104*a-n* may be operably configured to rotate backwards and forward with respect to the static sign plane 400.

To effectuate uninhibited rotation of the sign panels 104*a-n*, the wind-resistant sign assembly 100 may also include a plurality of panel off-set post members 208*a-n*. Using off-set post member 208*a* as an example, each of the panel off-set post members 208*a-n* may include a first end 126 directly coupled to either the first or second sign support member 102*a-b*, depending on what side of the sign panel 104*a* it is attached. To create a flush coupling configuration, the first end 126 of the panel off-set post members 208*a-n* may be substantially planar. The first end 126 of the panel off-set post members 208*a-n* may be coupled to one of the supports 102*a-b* with screws, bolts, adhesive, or another fastener. Further, the panel off-set post members 208*a-n* may include a second end 210, opposing the first end 126, that is directly coupled to one of the plurality of hinge members 200*a-n*.

The space between the first end 126 and the second end 210 make up the panel off-set post member length, e.g., length 402 (shown best in FIG. 4), which displaces each of the plurality of sign panels 104*a-n* a distance away from either the first and/or second sign support members 102*a-b* to which it is coupled. The panel off-set post members 208*a-n* may also include a substantially planar upper end 212, a substantially planar bottom end 214, opposing the upper end 212, a substantially planar rear surface 216, and a substantially planar front surface 218 opposing the rear surface 216. Beneficially, the post length 402 is greater than or equal to a sign-panel width, e.g., width 122, separating the upper end 120 and the bottom end 112 of each of the plurality of sign panels 104*a-n* to provide room for bi-directional rotation of the sign panels 104*a-n*. In some embodiments, the panel off-set post members 208*a-n* dispose each of the sign panels 104*a-n* at said post length 402 along the entire sign length 306 (shown in FIG. 3). In some embodiments, the panel off-set post members 208*a-n* dispose each of the sign panels 104*a-n* at a uniform distance along the entire sign length 306.

In one embodiment, the panel off-set post members 208*a-n* are of a wood material that may be coated with waterproof coating to sustain outside environmental conditions. In other embodiments, the panel off-set post members 208*a-n* are of a rigid metallic material (e.g., stainless steel), a polymeric material (e.g., PVC), or other substantially rigid material. In another embodiment, panel off-set post members 208*a-n* may be rods, tubes, poles or shafts and may have other shapes or lengths.

In one embodiment, the wind-resistant sign assembly 100 may beneficially include a plurality of hinge members 200*a-n* to facilitate in enabling rotation of the sign panels 104*a-n*. The hinge members 200*a-n* may couple to each of the plurality of sign panels 104*a-n* on either the front or rear surfaces 114, 204. Specifically, the hinge members 200*a-n* couple the sign panels 104*a-n* to the panel off-set post members 200*a-n*, which are thereby coupled to the support members 102*a-b* (as discussed above). Using hinge member 200*a* as an example, each of plurality of hinge members 200*a-n* may be coupled proximal to or at one of the sides 116, 118 of a sign panel 104*a*. In one embodiment, the hinge member 200*a* is coupled to and disposed on the rear surface 204 of sign panel 104*a*, thereby coupling the sign panel 104*a* to panel off-set post member 200*a*, which thereby couples the sign panel 104*a* to the support member 102*a*. In other embodiments, the hinge member 200*a* may be coupled to the upper end 120 of each of the plurality of sign panels 104*a-n*. Those of skill in the art will appreciate that the same coupling configuration and placement of a hinge member will be duplicated for the left side 118 of the sign panel 104*a*. In one embodiment, the plurality of hinge members 200*a-n* may each include a spring member, e.g., spring member 222, operably configured to generate a spring force biasing each of the respectively coupled plurality of sign panels in the static position. Said another way, the spring-loaded hinges are operably configured to keep each of the plurality of sign panels 104*a-n* in a resting, static, position when they are not being presented with an external force upon them, such as wind, that is able to overcome the biasing force, e.g., approximately 5-10 lbf.

In a further embodiment, when the sign panels 104*a-n* are disposed in the static position, the front surfaces 114 of each of the plurality of sign panels 104*a-n* are biased, through a spring force generated by the spring member 222, in a configuration with one another to define a substantially planar collective front sign surface 114 defining a static sign plane 400. When the biasing force caused by the spring member 22 has been overcome, the one or more sign panel(s) 104*a-n* may be placed in a dynamic position (shown best in FIGS. 2-3) with said one or more sign panel(s) 104*a-n* rotated and disposed at an acute angle α with respect to the static sign plane 400 for entry and egress of wind. The hinge members 200*a-n* may be one or more of the following: Butt hinges, pivot hinges, butterfly hinges, barrel hinges, or other types of hinges. As seen in FIGS. 5-11, a few exemplary embodiments of other types of hinge members, e.g., hinge members 510, 908, are shown.

In a further embodiment, when the sign panels 104*a-n* are in dynamic position, the front surface 114 of one or more of the plurality of sign panels 104*a-n* is disposed at an acute angle α with respect to the front surface 114 of another of the plurality of sign panels 104*a-n* disposed adjacently thereto to define a gap 220 between the bottom end 112, along the sign panel length 306, and the upper end 110 of the another of the plurality of sign panels, e.g., sign panel 104*b*, disposed adjacently thereto. In another embodiment, when the sign panels 104*a-n* lay in a static position, the front surfaces 114 are biased in a configuration with one another to define a substantially planar collective front sign surface 114 (as best seen in FIG. 1) defining a static sign plane 400.

With reference to FIGS. 5-11, other embodiments of a wind-resistant sign assembly are depicted. Still, however, the sign panels are each individually beneficially capable of rotation along a sign panel rotation path, as described above. Specifically, each of the sign panels may have a static position with the front surfaces of each sign panel substantially co-planar with one another and a dynamic position with at least one of the plurality of sign panels rotated and disposed at an acute angle, e.g., angles β, Ω, and π (depicted in FIGS. 3, 7, and 9, respectively), with respect to the static sign plane for entry and egress of wind.

Figures 6, 6A:
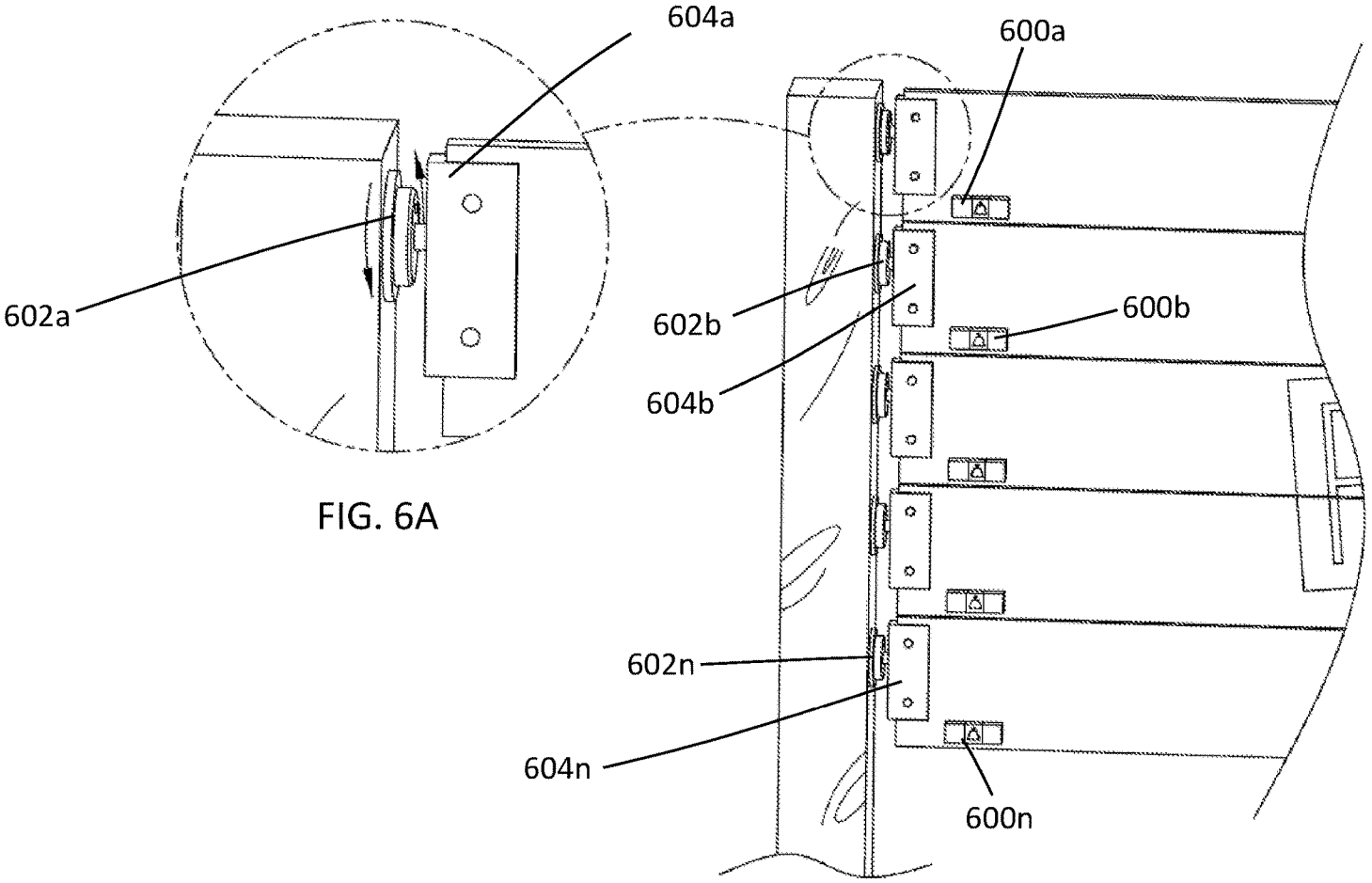
FIG. 6 is fragmentary perspective front view of the wind-resistant sign assembly in FIG. 5.
FIG. 6A is a fragmentary close-up of a hinged connection between a sign panel and a post of the wind-resistant sign assembly in FIG. 6 in accordance with one embodiment of the present invention.
Figure 7:
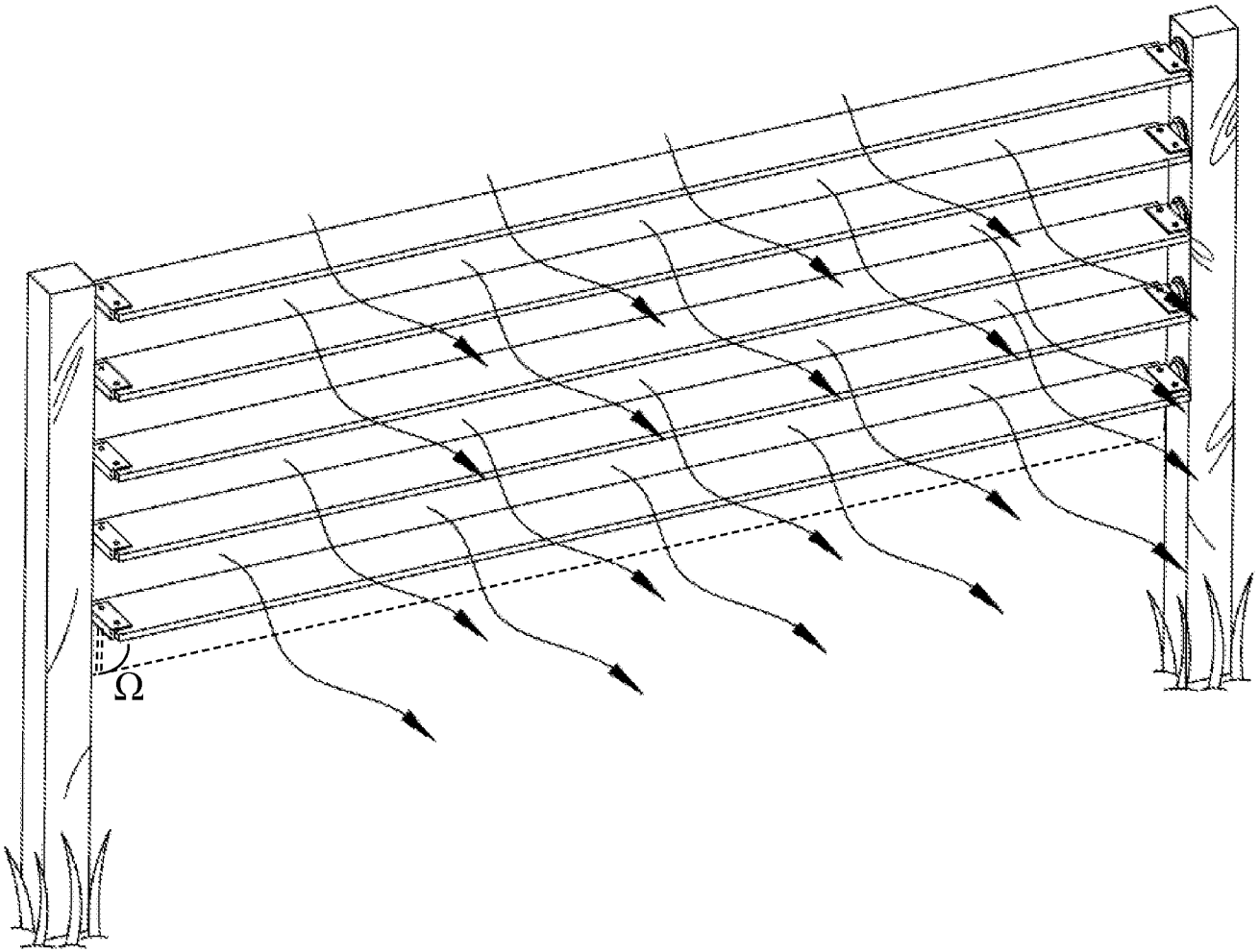
FIG. 7 is a perspective view of the wind-resistant sign assembly in FIG. 5 with a plurality of sign panels angled to permit entry and egress of wind in accordance with another embodiment of the present invention.

In further embodiments, the return of the plurality of panels from a dynamic position to a static position may be achieved by utilizing one or more weights 300*a-n*, 600*a-n* coupled to either the front or rear surfaces of each of the plurality of panels, as seen in FIGS. 3 and 6. The weights 300*a-n*, 600*a*-n may be made of metallic material (e.g., stainless steel, iron), a polymeric material (e.g., PVC). When the sign panels are presented with a wind force, hinges disposed on each of the sign panels enable the sign panels to follow a rotational path and be placed in a dynamic position. When the exertion of the wind force terminates or subsides, the individual sign panels will return to their static position as a result of the weights 300*a-n* and 600*a-n*.

Referring to FIGS. 1-3, the weights 300*a-n* are placed on either or both the front and/or rear surfaces 114, 204 of each of the plurality of sign panels 104*a-n*. The weights 300*a-n* may also be placed on and at or proximal to opposing right and left bottom corner sides of each sign panel. The weights 300*a-n* may be uniformly spaced on each sign panel as well or may be otherwise intermittently spaced to allow the panels to raise and lower substantially uniformly along its length 306. In other embodiments, the weights 300*a-n* may span the entire bottom portion of either or both of the front or rear surfaces 114, 204 of a sign panel.

Figure 5:
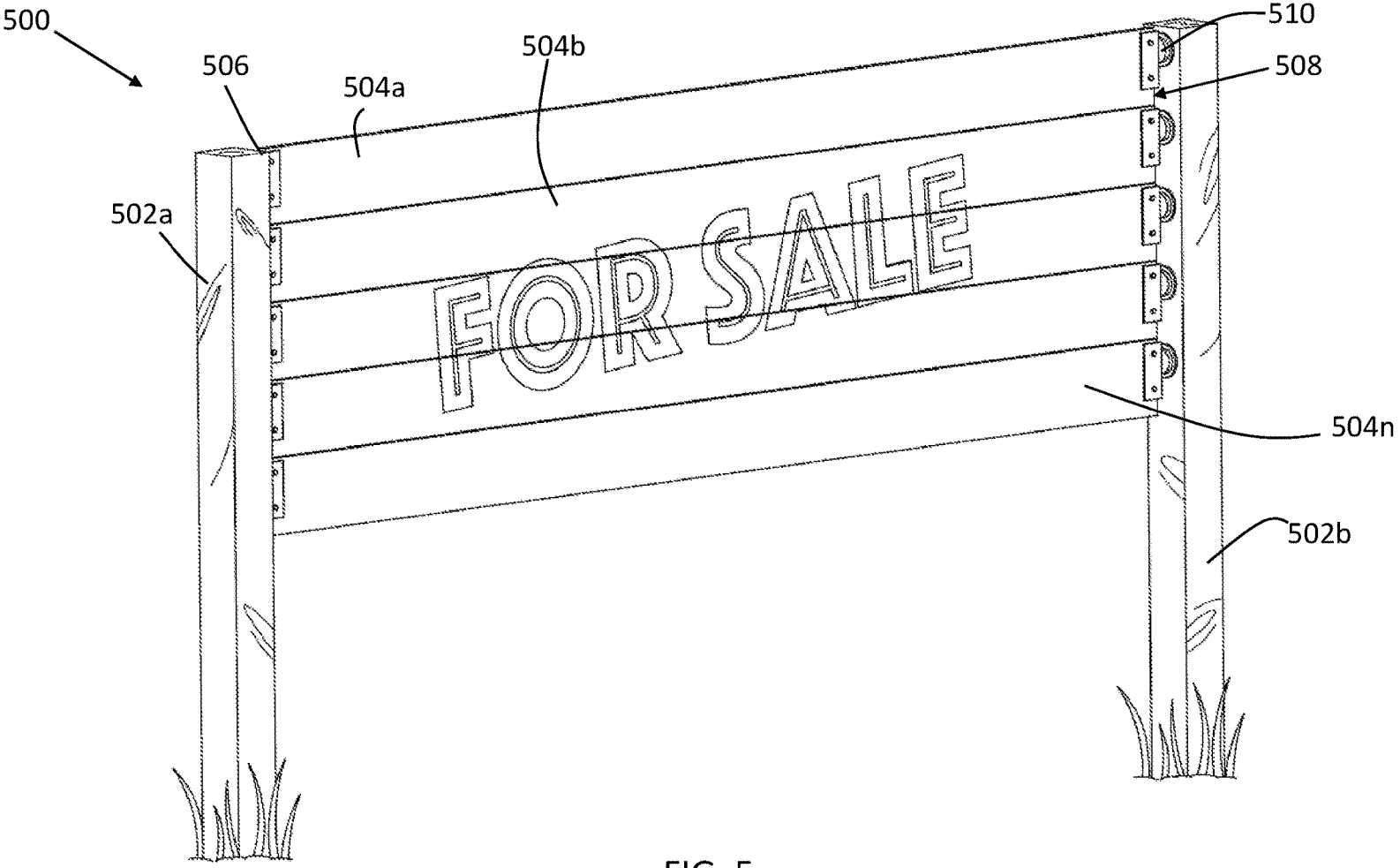
FIG. 5 is perspective view of a wind-resistant sign assembly according to another embodiment of the present invention.

Referring now to FIG. 5, another embodiment of the present invention is shown in a perspective view. Included in this example of a wind-resistant sign assembly 500, as shown in FIGS. 5-8, are similar features to that of the wind-resistant sign assembly 100 depicted in FIGS. 1-4, including sign support members 502*a-b* and a plurality of sign panels 504*a-n*. Additionally, in this embodiment, the wind-resistant sign assembly 500 beneficially includes a plurality of barrel hinge members 602*a-n* coupling the sign panels 504*a-n* to the sign support members 502*a*, 502*n*. The barrel hinge members 602*a-n* allow the sign panels 504*a-n* to independently and bi-directionally rotate with respect to a static sign plane, as best depicted by the arrows in FIG. 6A.

Figure 8:
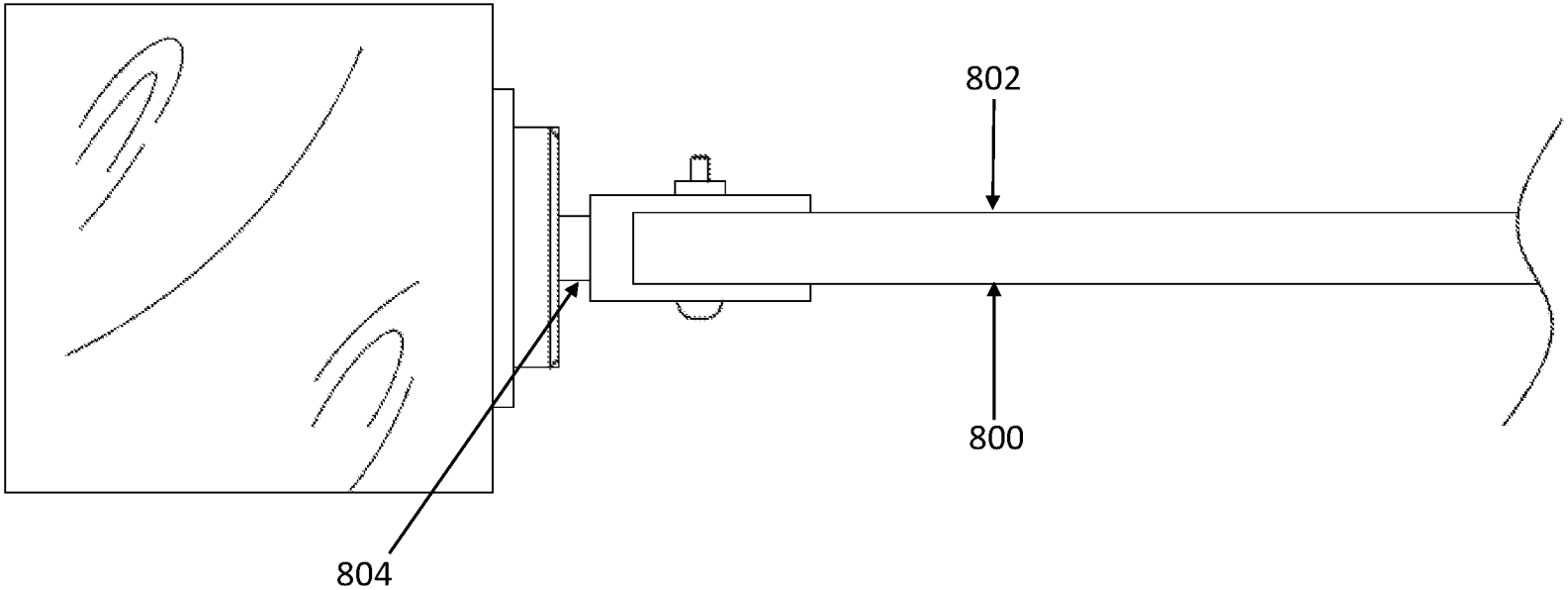
FIG. 8 is a fragmentary top plan view of the wind-resistant sign assembly in FIG. 5 in accordance with one embodiment of the present invention.

As shown in FIGS. 5-8, the sign panels 504*a-n* may be connected to sign support members 502*a-b* via barrel hinge members 602*a-n* and panel clamp members 604*a-n*. FIGS. 6-6A best depict the manner in which barrel hinge members 602*a-n* couple to panel clamp members 604*a-n*, which couple to sign panels 504*a-n*, respectively. As a representative sample of the placement of each barrel hinge member 602*a-n* and each panel clamp member 604*a-n* on each sign panel 504*a-n*, respectively, the placement of barrel hinge member 602*a* and panel clamp member 604*a* on sign panel 504*a* in one embodiment will be described herein. The sign panel 504*a* may be coupled to panel clamp member 604*a* on the first side end 506. The panel clamp member 604*a* may grasp the sign panel 504*a* by holding the sign panel on the front surface 800, the rear surface 802, and the first side end 804, as shown in FIG. 8. The panel clamp member 604*a* may couple to the sign panel 504*a* using one or more fasteners. The panel clamp member 604*a* may then be coupled to barrel hinge member 602*a*. The barrel hinge member 602*a* may also be coupled to sign support member 502*a* on the first side end 506. The placement of hinge member 602*a* on the side end 506 of sign panel 504*a* couples the sign panel 504*a* to support member 502*a*. This same hinge placement would be duplicated for the left side of the sign panels 504*a-n* coupling each sign panel to support member 502*b*.

Figure 9:
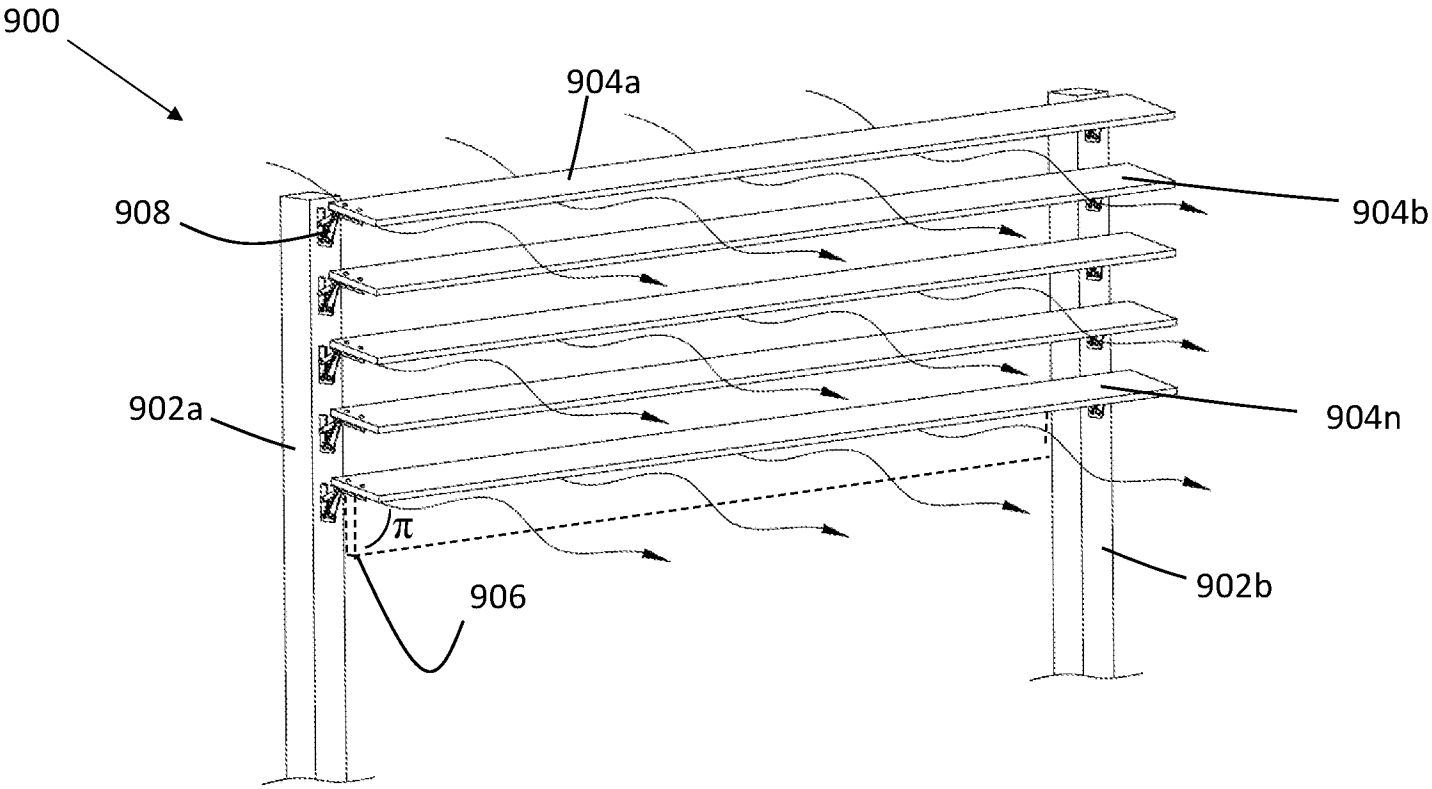
FIG. 9 is a perspective view of a wind-resistant sign assembly with a plurality of sign panels angled to permit entry and egress of wind in accordance with another embodiment of the present invention.
Figure 10:
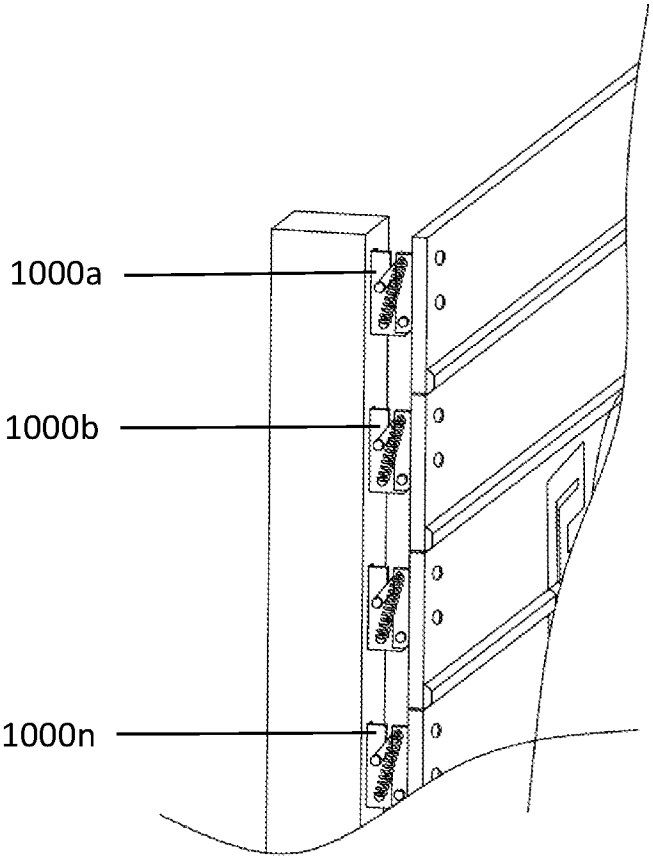
FIG. 10 is fragmentary close-up side view of the wind-resistant sign assembly in FIG. 9.
Figure 11:
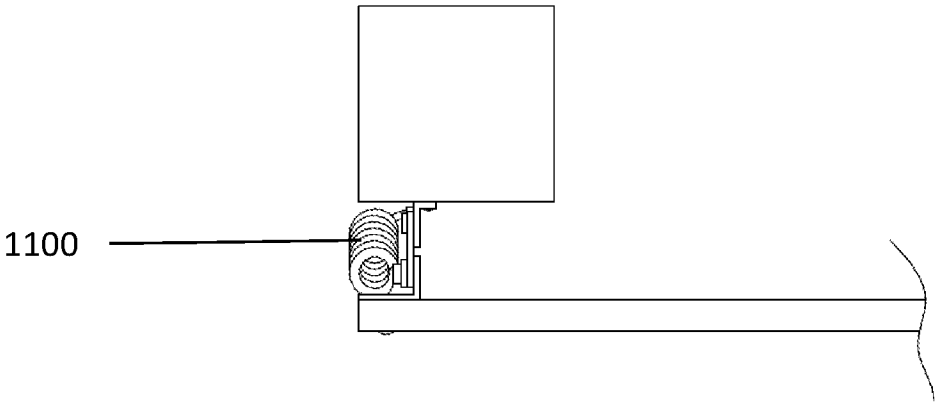
FIG. 11 is a fragmentary top plan view of the wind-resistant sign assembly in FIG. 9 in accordance with one embodiment of the present invention.

Another embodiment of the present invention features pivot hinge members, as depicted in FIGS. 9-11. This embodiment also features many of the same main components included within the wind-resistant assemblies 100 and 500 depicted in FIGS. 1 and 5. The wind-resistant sign assembly 900 similarly includes sign support members 902*a-b* and a plurality of sign panels 904*a-n*. Additionally, in this embodiment, wind-resistant sign assembly 900 beneficially includes a plurality of pivot hinge members 1000*a-n* coupling the sign panels 904*a-n* to the sign support members 902*a*, 902*n*.

In a further embodiment, the pivot hinge members 1000*a-n* couple each of the sign panels 904*a-n* on either the front or rear surfaces, and in some instances, both the front and rear surfaces. As a representative sample of the placement of pivot hinge members 1000*a-n* on sign panels 904*a-n*, the placement of pivot hinge member 1000*a* on sign panel 904*a* will be described herein. A single sign panel 904*a* may be coupled to two pivot hinge members on opposing right and left side ends of the panel located on either or both of the front or rear surfaces of the sign panel 904*a*. Referring specifically to FIGS. 10-11, the left placement of pivot hinge member 1000*a* on the rear surface of sign panel 904*a* couples the sign panel 904*a* to support member 902*a*. This same pivot hinge member placement would be duplicated for the right side of the sign panels 904*a-n* coupling each sign panel to support member 902*n*.

In a further embodiment, when the plurality of sign panels 904*a-n* are presented with an exerting force to the point in which the exerting force proves to be unsustainable by at least one of the plurality of sign panels 904*a-n* in the static position, pivot hinge members 1000*a-n* are each individually capable of stretching, through use a spring member 1100, into a Z formation and bringing the sign panels 904*a-n* to their dynamic position. FIG. 9 best depicts the pivot hinge members 1000*a-n* in their extended form, while FIG. 10 best depicts the pivot hinge members 1000*a-n* in their compact form when the sign panels 904*a-n* are not being presented with an exerting force, such as wind.

In one embodiment, best depicted in FIG. 11, the pivot hinge members 1000*a-n* may each comprise a coil-spring assist member 1100 generating a spring force biasing each of the respectively coupled plurality of sign panels in the static position. Said another way, the coil spring assist members 1100 may keep the plurality of sign panels 904*a-n* in a resting, static position when they are not being presented with an exerting force upon them, such as wind.

A wind-resistant sign assembly has been disclosed that includes at least two sign support members coupled to a plurality of hinges which are respectively coupled to plurality of sign panels. The plurality of sign panels are each individually and independently operably configured to efficiently and effectively rotate along a sign panel rotation path into a dynamic position, allowing for the entry and egress of wind.

What is claimed is:

1. A wind-resistant sign assembly comprising:

a first sign support member and a second sign support member disposed in a substantially parallel orientation with respect to the first sign support member, the first and second sign support members inserted into a ground surface and defining a space thereinbetween; and a plurality of sign panels of a substantially rigid material and each operably configured to independently rotate with respect to one another and each having:

a first side end, a second side end opposing the first side end, an upper end, a bottom free end opposing the upper end, a rear surface, a front surface opposing the rear surface, and a sign length separating the first and second side ends;

a plurality of hinge members each coupling the sign panel to the first and second sign support members, respectively;

a static position along a sign panel rotation path with the front surface coplanar with, and the bottom end along the sign length disposed proximal to, without any intervening structure, the front surface and upper end, respectively, of one of the plurality of sign panels disposed adjacently thereto; and a dynamic position along the sign panel rotation path with the front surface disposed at an acute angle with respect to the front surface of one of the plurality of sign panels disposed adjacently thereto to define a gap, of a uniform length, between the bottom end, and spanning along, along the sign panel length and the upper end of the one of the plurality of sign panels disposed adjacently thereto for entry and egress of wind.

2. The wind-resistant sign assembly according to claim 1, wherein:

the first and second sign support members are independently and indirectly coupled with one another.

3. The wind-resistant sign assembly according to claim 1, wherein each of the plurality of hinge members further comprises:

a spring member generating a spring force biasing each of the respectively coupled plurality of sign panels in the static position.

4. The wind-resistant sign assembly according to claim 3, wherein the static position defines a substantially planar collective front sign surface defined by the front surfaces of each of the plurality of sign panels.

5. The wind-resistant sign assembly according to claim 4, wherein the front surfaces of each of the plurality of sign panels span the sign length.

6. The wind-resistant sign assembly according to claim 4, wherein the substantially planar collective front sign surface further comprises:

a static sign plane, wherein the plurality of sign panels are operably configured to independently and bi-directionally rotate with respect to the static sign plane.

7. The wind-resistant sign assembly according to claim 1, further comprising:

a plurality of panel off-set post members, each with a first end directly coupled to at least one of the first and second sign support members, a second end, opposite the first end of the respective panel off-set post member, coupled to one of the plurality of hinge members, and displacing each of plurality of sign panels a distance away from the at least one of the first and second sign support members to which it is coupled.

8. The wind-resistant sign assembly according to claim 7, wherein each of the plurality of panel off-set post members further comprise:

a post length separating the first and second ends of the panel off-set post member, the post length greater than or equal to a sign-panel width separating the upper and bottom ends of each of the plurality of sign panels spanning the sign length.

9. The wind-resistant sign assembly according to claim 8, wherein:

the sign-panel width is of a substantially uniform length.

10. A wind-resistant sign assembly comprising:

first and second sign support members inserted into, and disposed in a substantially orthogonal orientation with respect to, a ground surface to define a space separating the first and second sign support members;

a plurality of panel off-set post members, each with a first end directly coupled to at least one of the first and second sign support members, a second terminal end, opposite the first end of the respective panel off-set post member; and a plurality of sign panels, each:

having a first side end, a second side end opposing the first side end, an upper end, a bottom free end opposing the upper end, a rear surface, a front surface opposing the rear surface, and a sign length separating the first and second side ends of the sign panel and spanning the space separating the first and second sign support members;

coupled to the plurality of panel off-set post members through, respectively, a plurality of hinge members each having a spring member and coupling the sign panel to the first and second sign support members, respectively, the plurality of panel off-set post members displacing each of plurality of sign panels a uniform distance away from the at least one of the first and second sign support members to which it is coupled along the entire sign length; and operably configured to independently rotate with respect to one another along a sign panel rotation path having a static position and a dynamic position, the static position with the front surfaces of each of the plurality of sign panels biased, through a spring force generated by the spring member, in a configuration with one another to define a substantially planar collective front sign surface defining a static sign plane and the dynamic position with at least one of the plurality of sign panels rotated and disposed at an acute angle with respect to the static sign plane for entry and egress of wind.

11. The wind-resistant sign assembly according to claim 10, wherein the dynamic position further comprises:

the front surface of the at least one of the plurality of sign panels disposed at an acute angle with respect to the front surface of another of the plurality of sign panels disposed adjacently thereto to define a gap between the bottom end along the sign panel length and the upper end of the another of the plurality of sign panels disposed adjacently thereto.

12. The wind-resistant sign assembly according to claim 10, further comprising:

the front surfaces of each of the plurality of sign panels span the sign length.

13. The wind-resistant sign assembly according to claim 10, wherein:

the plurality of sign panels are operably configured to independently and bi-directionally rotate with respect to the static sign plane.

14. The wind-resistant sign assembly according to claim 10, wherein each of the plurality of panel off-set post members further comprise:

a post length separating the first and second ends of the panel off-set post member, the post length greater than or equal to a sign-panel width separating the upper and bottom ends of each of the plurality of sign panels spanning the sign length.

15. The wind-resistant sign assembly according to claim 14, wherein:

the sign-panel width is of a substantially uniform length.

* * * * *